US010944186B2

(12) United States Patent
Van Gils et al.

(10) Patent No.: US 10,944,186 B2
(45) Date of Patent: Mar. 9, 2021

(54) ANTENNA SYSTEM AND ANTENNA MODULE WITH REDUCED INTERFERENCE BETWEEN RADIATING PATTERNS

(71) Applicants: TE Connectivity Nederland BV, s'Hertogenbosch (NL); TE Connectivity Germany GmbH, Bensheim (DE)

(72) Inventors: Wijnand Van Gils, Raamsdonksveer (NL); Luc Van Dommelen, Udenhout (NL); Sheng-Gen Pan, Kamp-Lintfort (DE); Christian Rusch, Karlsruhe (DE); Andreas Winkelmann, Sindelfingen (DE); Daniel Volkmann, Lautertal (DE)

(73) Assignees: TE Connectivity Nederland BV, s'Hertogenbosch (NL); TE Connectivity Germany GmbH, Bensheim (DE)

( * ) Notice: Subject to any disclaimer, the term of this patent is extended or adjusted under 35 U.S.C. 154(b) by 208 days.

(21) Appl. No.: 15/807,019

(22) Filed: Nov. 8, 2017

(65) Prior Publication Data

US 2018/0069326 A1 Mar. 8, 2018

Related U.S. Application Data

(63) Continuation of application No. PCT/EP2016/060211, filed on May 6, 2016.

(30) Foreign Application Priority Data

May 8, 2015 (EP) ..... 15166990

(51) Int. Cl.

| | |
|---|---|
| ***H01Q 1/52*** | (2006.01) |
| ***H01Q 21/30*** | (2006.01) |
| ***H01Q 21/28*** | (2006.01) |

(52) U.S. Cl.
CPC ..... *H01Q 21/30* (2013.01); *H01Q 1/521* (2013.01); *H01Q 21/28* (2013.01)

(58) Field of Classification Search
CPC ..... H01Q 21/30; H01Q 1/521; H01Q 21/28; H01Q 1/085; H01Q 1/087; H01Q 1/3291
See application file for complete search history.

(56) References Cited

U.S. PATENT DOCUMENTS 5,038,151 A * 8/1991 Kaminski ..... H01Q 1/525 343/727
5,610,620 A * 3/1997 Stites ..... H01Q 1/28 343/700 MS (Continued)

FOREIGN PATENT DOCUMENTS

CN 101461093 A 6/2009
CN 103840259 A 6/2014

(Continued)

OTHER PUBLICATIONS

PCT International Search Report and Written Opinion of the International Searching Authority, dated Oct. 4, 2016, 17 pages.

(Continued)

*Primary Examiner* — Dimary S Lopez Cruz
*Assistant Examiner* — Bamidele A Jegede
(74) *Attorney, Agent, or Firm* — Barley Snyder

(57) ABSTRACT

An antenna system comprises a first antenna element adapted to a first frequency band and a second antenna element adapted to a second frequency band different from the first frequency band. The first antenna element includes a radiating structure having a planar radiating element and configured to radiate at a frequency in the first frequency band and a band-stop filter having a planar conductive element and configured to attenuate a current flow at a frequency in a second frequency band different from the first frequency band. The planar conductive element is arranged (Continued)

in a meander pattern, has an end electrically connected to the planar radiating element, extends in a direction substantially parallel to the planar radiating element, and has an electrical length substantially equal to ¼ of a wavelength of the frequency in the second frequency band.

20 Claims, 8 Drawing Sheets

(56) References Cited

U.S. PATENT DOCUMENTS 5,650,792 A * 7/1997 Moore ..... H01Q 1/362 343/725
5,973,648 A * 10/1999 Lindenmeier ..... H01Q 1/1271 343/700 MS
6,078,295 A * 6/2000 Rawle ..... H01Q 9/30 343/730
6,404,396 B1 * 6/2002 Hung ..... H01Q 1/085 343/722
6,466,172 B1 * 10/2002 Ryken ..... H01Q 1/286 343/700 MS
6,917,340 B2 * 7/2005 Lindenmeier ..... H01Q 1/521 343/713
7,053,845 B1 * 5/2006 Holloway ..... H01Q 1/22 343/708
7,652,632 B2 1/2010 Shtrom
7,786,937 B1 * 8/2010 Stierhoff ..... H01Q 21/28 343/700 MS
7,936,309 B2 * 5/2011 Lindenmeier ..... H01Q 1/3275 343/725
8,860,623 B2 10/2014 Lo et al.
2003/0011521 A1 * 1/2003 Edimo ..... H01Q 1/243 343/700 MS
2003/0090428 A1 * 5/2003 Marie ..... H01Q 1/528 343/787
2003/0227419 A1 * 12/2003 Hung ..... H01Q 5/321 343/790
2004/0183737 A1 * 9/2004 Lindenmeier ..... H01Q 21/28 343/725
2006/0220970 A1 * 10/2006 Aminzadeh ..... H01Q 21/28 343/713
2007/0268196 A1 * 11/2007 Steghafner ..... H01Q 9/30 343/893
2008/0165077 A1 * 7/2008 Hauck ..... H01Q 5/00 343/900
2009/0073072 A1 * 3/2009 Lindenmeier ..... H01Q 1/3275 343/810
2010/0253587 A1 * 10/2010 Lindenmeier ..... H01Q 7/00 343/797
2010/0283684 A1 * 11/2010 Rabinovich ..... H01Q 1/3275 343/700 MS
2010/0302112 A1 * 12/2010 Lindenmeier ..... H01Q 9/28 343/713
2012/0169552 A1 * 7/2012 Lee ..... H01Q 9/285 343/727
2012/0280888 A1 * 11/2012 Thiam ..... H01Q 9/0421 343/893
2013/0328742 A1 * 12/2013 Hirobe ..... H01Q 1/521 343/853

FOREIGN PATENT DOCUMENTS

JP 05145324 A 6/1993
JP 2009044206 A 2/2009
WO 9826471 A2 6/1998
WO 2008131157 A1 10/2008

OTHER PUBLICATIONS

Abstract of JPH05145324, dated Jun. 11, 1993, 1 page.
Abstract of JP2009044206, dated Feb. 26, 2009, 1 page.
Chinese Second Office Action and Search Report and English translation, dated Oct. 12, 2020, 38 pages.

* cited by examiner

ANTENNA SYSTEM AND ANTENNA MODULE WITH REDUCED INTERFERENCE BETWEEN RADIATING PATTERNS

CROSS-REFERENCE TO RELATED APPLICATIONS

This application is a continuation of PCT International Application No. PCT/EP2016/060211, filed on May 6, 2016, which claims priority under 35 U.S.C. § 119 to European Patent Application No. 15166990.0, filed on May 8, 2015.

FIELD OF THE INVENTION

The present invention relates to an antenna system and, more particularly, to an antenna system having a first antenna element and a second antenna element.

BACKGROUND

Antenna systems in the prior art having a first antenna element and a second antenna element have various structural advantages. The assembly of the antenna system as a single structural module allows mechanical and electrical components to be shared between the plural antenna elements. The plural antenna elements may be arranged within and share a same housing, a same base, may share same PCB circuitry, and may share a same electrical connection for transmitting/receiving electrical signals from the outside to/from the plural antenna elements within the antenna system. The arrangement of plural antenna elements in an antenna system, however, suffers from mutual interference effects with their respective radiating patterns.

In PCT International Application No. WO 98/26471 A1, frequency selective surfaces are applied in an antenna system to reduce mutual interference effects between two antenna elements. The disclosed antenna system comprises a first and a second antenna element. The first antenna element is capable of transmitting in a first frequency range and the second antenna element is capable of transmitting in a second—i.e. non-overlapping—frequency range.

In order to reduce interference effects, the antenna system additionally includes a frequency selective surface which is conductive to radio frequency energy in the first frequency range and reflective to radio frequency energy in the second frequency range. The frequency selective surface comprises repetitive metallization pattern structures that display quasi band-pass or quasi band-reject filter characteristics to radio frequency signals impinging upon the frequency selective surface.

U.S. Pat. No. 6,917,340 B2 also relates to an antenna system comprising two antenna elements. In order to reduce the coupling and hence interference effects, one of the two antenna elements is subdivided into segments which have an electrical length corresponding to ⅜ of the wavelength of the other antenna element. Further, the segments of the one antenna element are electrically interconnected via electric reactance circuits which possess sufficiently high impedance in the frequency range of the other antenna element and sufficiently low impedance in the frequency range of the one antenna element.

Even though the above described approaches allow for a reduced inference in the radiation patterns of two antenna elements, the design of the antenna system comprising the two antenna elements becomes more complicated in view of the incorporation of additional components, namely the manufacturing and arrangement of the incorporation of electric reactance circuits. In particular, the design of the electric reactance circuits and their arrangement on the respective antenna element is complex and necessitates additional development steps. Further the components of the electric reactance circuit as well as the, for instance soldered, electrical connection to the antenna elements introduces unacceptable variances to the frequency characteristic.

SUMMARY

An antenna system according to the invention comprises a first antenna element adapted to a first frequency band and a second antenna element adapted to a second frequency band different from the first frequency band. The first antenna element includes a radiating structure having a planar radiating element and configured to radiate at a frequency in the first frequency band and a band-stop filter having a planar conductive element and configured to attenuate a current flow at a frequency in a second frequency band different from the first frequency band. The planar conductive element is arranged in a meander pattern, has an end electrically connected to the planar radiating element, extends in a direction substantially parallel to the planar radiating element, and has an electrical length substantially equal to ¼ of a wavelength of the frequency in the second frequency band.

BRIEF DESCRIPTION OF THE DRAWINGS

The invention will now be described by way of example with reference to the accompanying figures, of which.

DETAILED DESCRIPTION OF THE EMBODIMENT(S)

Figure 1B:
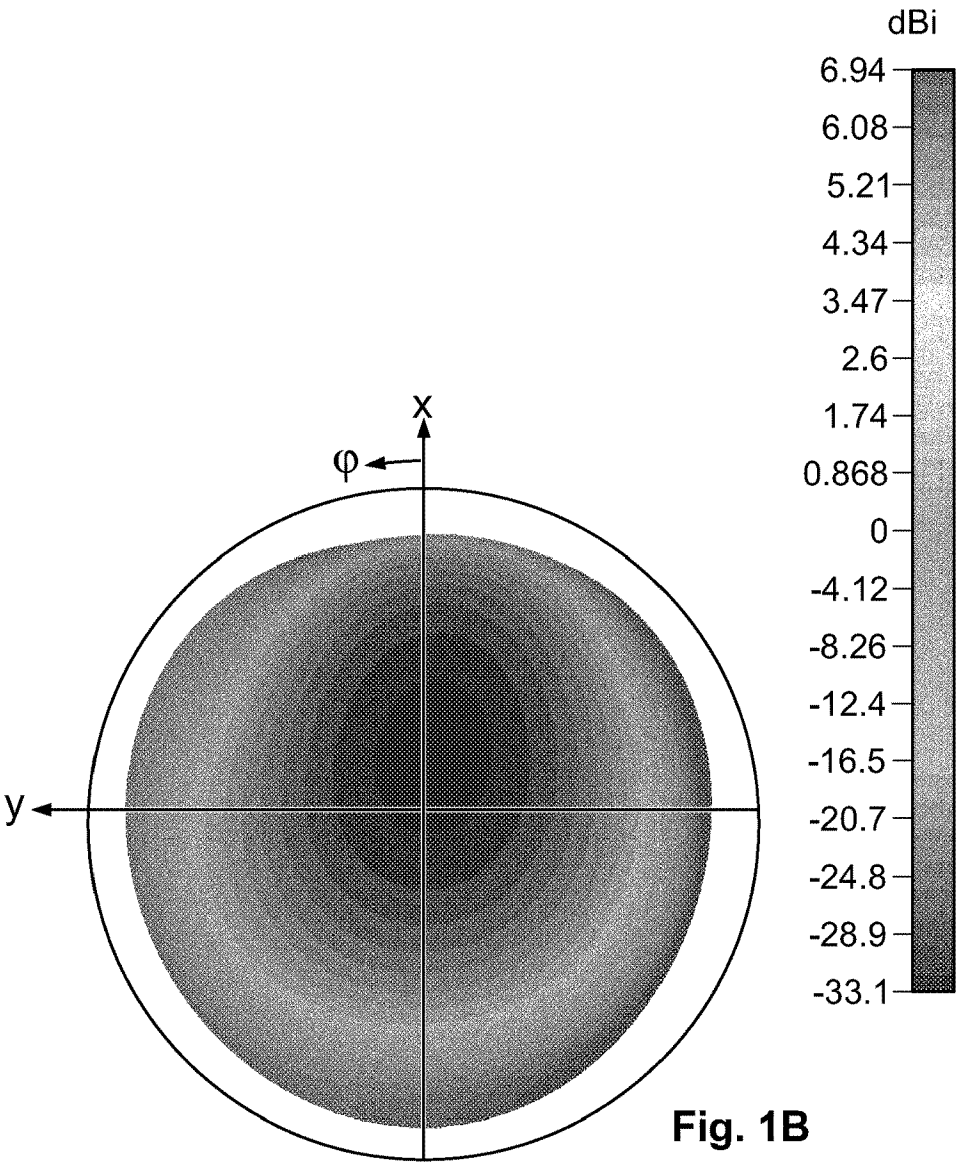
FIG. 1B is a simulated radiating pattern of the antenna system of FIG. 1A.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

Figure 1A:
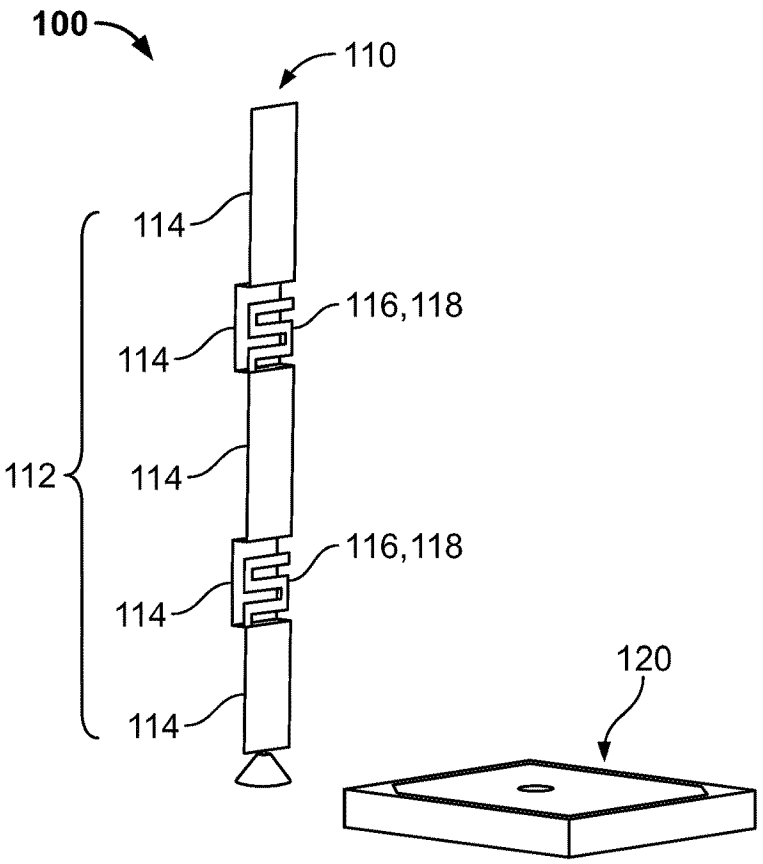
FIG. 1A is a perspective view of an antenna system according to an embodiment of the invention.

An antenna system 100 according to an embodiment of the invention is shown in FIGS. 1A and 1B. The antenna system 100 comprises a first antenna element 110 and a second antenna element 120 which are arranged within the near-field to each other. Accordingly, the radiation pattern of the second antenna element 120 is exposed to interference effects from the first antenna element 110 and vice-versa.

In the context of the invention, the term "near-field" is to be understood as the region around each of the first and second antenna element 110 and 120 where their radiating pattern is dominated by interference effects from the respective other of the first and second antenna element 110 and 120. For example, in case the first and second antenna elements 110 and 120 are shorter than half of the wavelength $\lambda$ they are adapted to emit, the near-field is defined as the region with a radius r, where $r<\lambda$.

The first antenna element 110 is adapted to transmit/receive electromagnetic waves of a first frequency band. In other words, the first antenna element 110 is adapted to the first frequency band. In the shown embodiment, the first antenna element 110 is a monopole antenna. In other embodiments, the first antenna element 110 may be, for instance, a dipole antenna, a planar inverted-F antenna (PIFA), or a multi-band antenna.

The second antenna element 120 is adapted to transmit/receive electromagnetic waves of a second frequency band. In other words, the second antenna element 120 is adapted to the second frequency band. In the shown embodiment, the second antenna element 120 is a planar antenna element, in an embodiment, a corner-truncated patch antenna. In other embodiments, the second antenna element 120 may be any other form of antenna known to those with ordinary skill in the art.

The first frequency band, to which the first antenna element 110 is adapted, and the second frequency band, to which the second antenna element 120 is adapted, are different from each other. In an embodiment, the first frequency band is lower than the second frequency band; the first frequency band includes frequencies which are smaller than that of the second frequency band. This includes cases where the first and the second frequency band have no overlap in frequency with each other. Furthermore, if one or both antenna elements 110 and 120 is/are multi-band antenna(s), the first frequency band may also encompass the second frequency band.

The first antenna element 110, as shown in FIG. 1A, has at least one radiating structure 112 configured to radiate at a frequency in the first frequency band. In the shown embodiment, the first antenna element 110 is a single radiating structure 112. In other embodiments, the first antenna element 110 is a multi-band antenna and comprises a plurality of radiating structures each of which radiates at a different frequency in the first frequency band.

The at least one radiating structure 112, as shown in FIG. 1A, has at least one planar radiating element 114 and is formed of segments of at least one or plural planar radiating elements 114. In the shown embodiment, the single radiating structure 112 has five planar radiating elements 114, but one with ordinary skill in the art would understand that the radiating structure 112 may have a number of planar radiating elements 114 other than five. In the embodiment shown in FIG. 1A, the five planar radiating elements 114 of the single radiating structure 112 are arranged on two parallel planes in an interleaved manner, such that the first, the third and the fifth radiating element 114 extend along a first plane of the two parallel planes and the second and the fourth radiating element 114 extend along a second of the two parallel planes. Each of the electrically interconnected planar radiating elements 114 has an electrical length of less than or equal to ⅜ of the wavelength of the frequency in the second frequency band.

The single radiating structure 112 can be manufactured by folding the radiating structure 112 so as to form the different planar radiating elements 114. Alternatively, the radiating structure 112 may be manufactured by printing/etching consecutive planar radiating elements 114 on opposite surfaces of a dielectric substrate. In the latter case, the consecutive planar radiating elements 114 can be electrically connected by means of a through connection (e.g. via) in-between the opposite surface of the dielectric substrate.

The first antenna element 110, as shown in FIG. 1A, further comprises at least one band-stop filter structure 116 configured to attenuate a current flow at a frequency in the second frequency band within the first antenna element 110. In other words, the at least one band-stop filter structure 116 suppresses current from flowing within the at least one radiating structure 114 which has a frequency in the second frequency band.

The at least one band-stop filter structure 116, as shown in FIG. 1A, comprises at least one planar conductive element 118 which is electrically connected at one end (which is the case for antenna system 100) or at both ends (which is the case for the antenna system 200, and 300 described below) to the at least one planar radiating element 114 of the at least one radiating structure 112. In the shown embodiment, each of the at least one band-stop filter structures 116 has one planar conductive element 118. In other embodiments, the at least one band-stop filter structure 116 may comprise a plurality of planar conductive elements 118, for instance, two planar conductive elements 118, and each of these two planar conductive elements 118 is electrically connected at one end to the same planar radiating element 114 at different portions thereof. The at least one planar conductive element 118 has a predetermined electrical length which corresponds to a quarter of a wavelength (¾) of the frequency in the second frequency band.

The at least one planar conductive element 118, as shown in FIG. 1A, is arranged in a meander pattern. In the context of the invention, the at least one planar conductive element 118 is said to be arranged in a meander pattern provided it has consecutive loops of conductive segments pointing in opposite traverse directions. The meander pattern of the at least one planar conductive element 118 allows for an excessive electrical length compared to the dimension (i.e. length and width) of the area in which it extends. In the shown embodiment, the at least one planar conductive element 118 has three consecutive loops of conductive segments pointing in opposite traverse directions.

The at least one planar conductive element 118, as shown in FIG. 1A, extends in a direction substantially in parallel to a direction of the at least one planar radiating element 114 of the at least one radiating structure 112. In other words, the at least one planar conductive element 118 extends in the same direction as the at least one planar radiating element 114. Thereby, the at least one planar conductive element 118 and the at least one radiating element 114 are both exposed to a same radiating pattern of the second antenna element 120 inducing a current of a same magnitude and directivity therein.

The at least one planar conductive element 118 and the at least one planar radiating element 114 are arranged facing each other in two parallel planes. This arrangement of the at least one planar conductive element 118 and at least one planar radiating element 114 advantageously increases the coupling therebetween. The coupling between the at least one planar conductive element 118 and at least one planar radiating element 114 enhances the filtering effect of the at least one band-stop filter structure 116. The at least one planar conductive element 118 is shaped such that it covers the width of the at least one planar radiating element 114 of the at least one radiating structure 112; the overlap between the at least one planar conductive element 118 and the at least one planar radiating element 114 is increased, further enhancing the coupling therebetween. In another embodiment, the at least one planar conductive element 118 and the at least one planar radiating element 114 are disposed on two opposing surfaces of a dielectric substrate where a suitably small relative permittivity of the dielectric substrate further enhances the coupling therebetween.

In the embodiment shown in FIG. 1A, one radiating structure 112 of the first antenna element 110 has five electrically interconnected planar radiating elements 114 and two band-stop filter structures 116 each of which includes one planar conductive element 118. The one planar conductive element 118 of each of the two band-stop filter structures 16 is electrically connected to every other of the five electrically interconnected planar radiating elements 114. Due to this configuration of the at least one planar conductive element 118 and of the at least one planar radiating element 114 to which it is electrically connected, the at least one band-stop filter structure 116 act as a band-stop filter for an induced current at the frequency in the second frequency band, thereby attenuating a current flow at a frequency in the second frequency band. A current which is induced in the at least one planar conductive element 118 is reflected at the not electrically connected end of the at least one planar conductive element 118 and hence is exposed to an electrical length of twice a quarter of the wavelength ($2\cdot\lambda/4=\lambda/2$) of the frequency of the second frequency band compared to a current induced in the at least one planar radiating element 114. With a phase offset of half of the wavelength ($\lambda/2$) of the frequency of the second frequency band, both currents destructively interfere (i.e. cancel each other out). Accordingly, even if the second antenna element 120 induces a current in the first antenna element 110, the at least one planar conductive element 118 of the band-stop filter structure 116 suppresses the induced current at the frequency of the second frequency band.

The first antenna element 110 is configured to reduce interference effects at the frequency of the second frequency band, namely the frequency to which the second antenna element 120 is adapted. The first antenna element 110 can be said to be transparent to the second antenna element 120. Accordingly, the radiating pattern of the second antenna element 120 is exposed to a reduced amount of interference from the first antenna element 110, even if the first antenna element 110 is arranged within the near-field thereof.

A same effect of a reduction in interference to the radiating pattern of the second antenna element 120 can also be appreciated from the simulation radiating pattern results shown in FIG. 1B. The radiating pattern of the second antenna element 120 is nearly concentric and only marginal deformations are with respect to the x-axis, i.e. the direction in which the first antenna element 110 was arranged for simulation purposes.

Figure 2A:
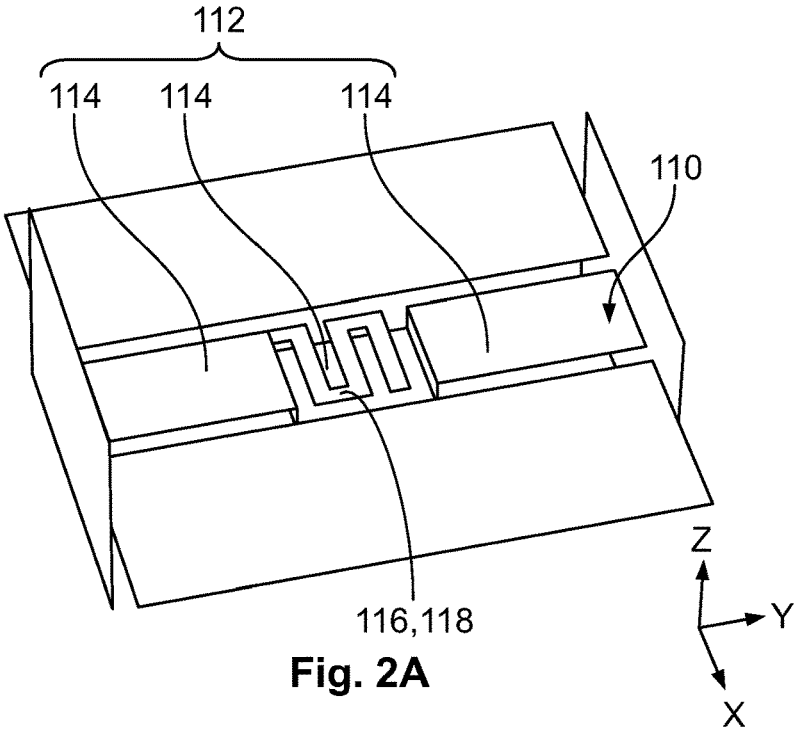
FIG. 2A is a sectional perspective view of a first antenna element of the antenna system of FIG. 1A.
Figure 2B:
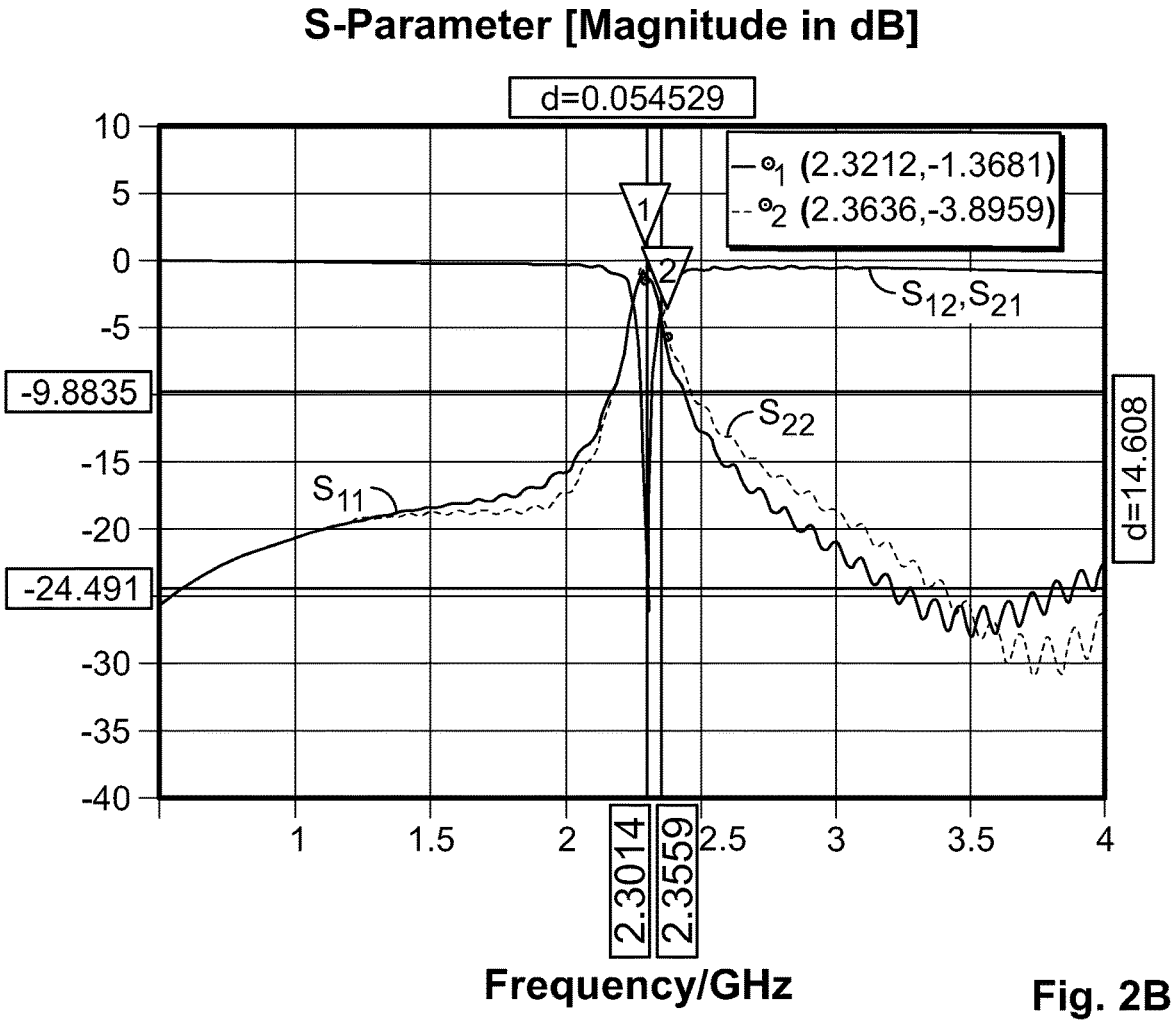
FIG. 2B is a graph of a two-port scattering parameter simulation of the first antenna element of FIG. 2A.

A two-port scattering pattern or s-parameter simulation is shown in FIG. 2B. For the simulation, the left and the right section of the first antenna element 110 shown in FIG. 2A are the ports to the two-port s-parameter simulation. As can be appreciated from the simulation results, the forward gain and the reverse gain coefficients S12 and S21 show a high attenuation at the frequency of 2.3014 GHz corresponding to the frequency of the second frequency range for which each of the at least one band-stop filter structure 116 is configured. The reflection coefficients S11 and S22 show an inverse behavior.

Figure 3A:
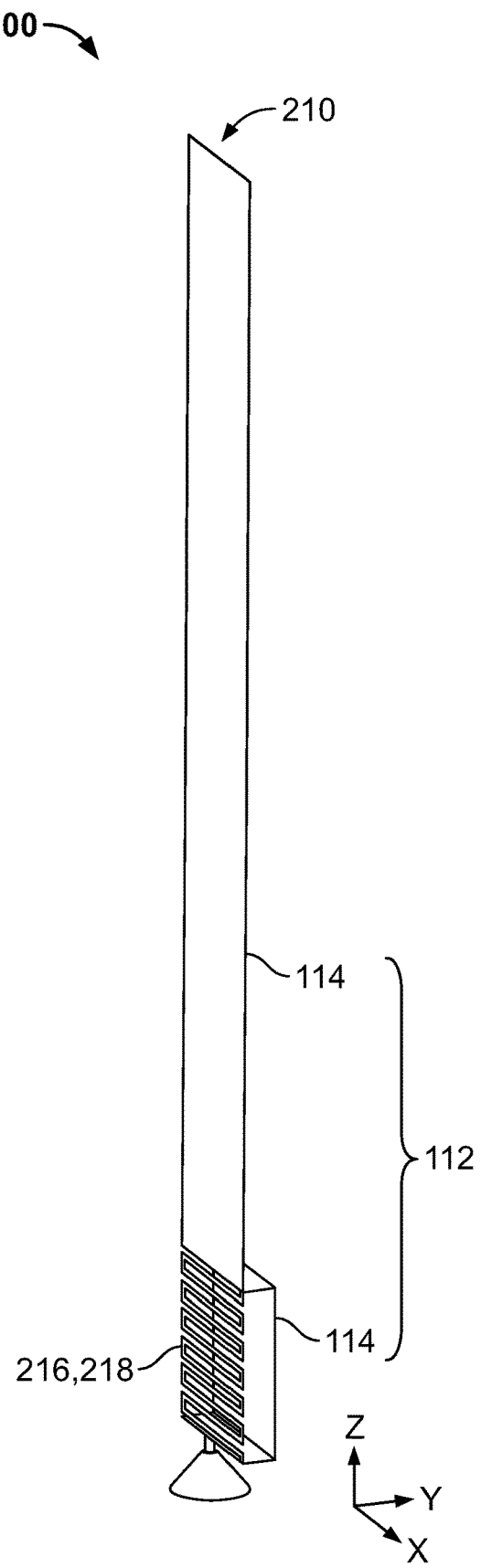
FIG. 3A is a perspective view of a first antenna element of an antenna system according to another embodiment of the invention.
Figure 3B:
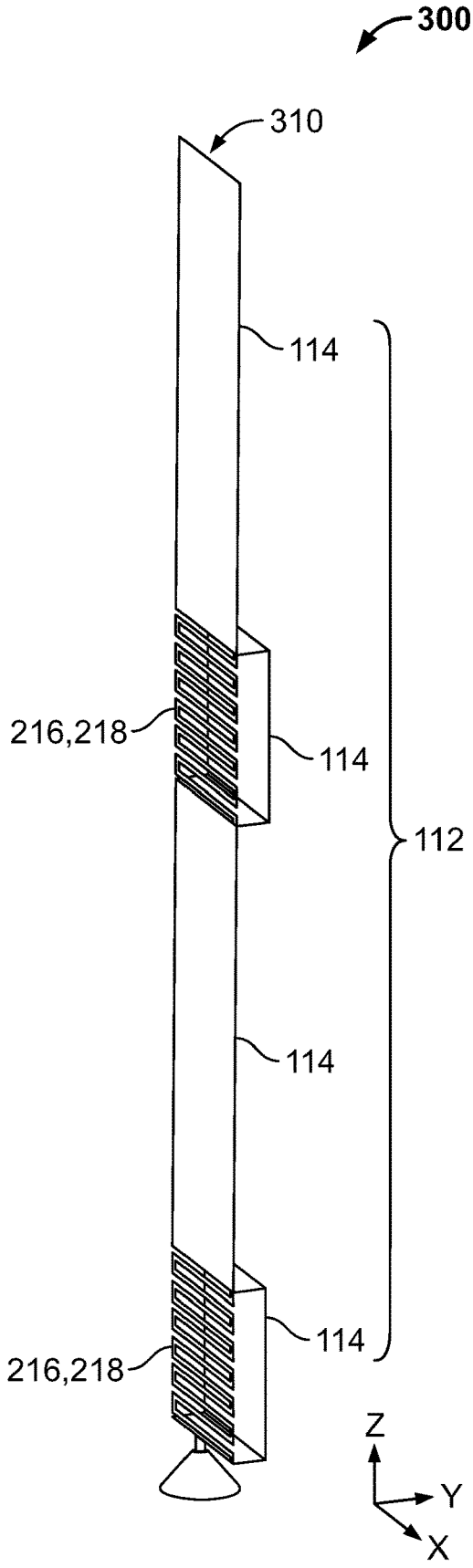
FIG. 3B is a perspective view of a first antenna element of an antenna system according to another embodiment of the invention.

An antenna system 200 and an antenna system 300 according to other embodiments of the invention are shown in FIGS. 3A and 3B. Each of the antenna systems 200 and 300 comprises a first antenna element 210, 310 and a second antenna element 120 such as that shown in FIG. 1A. The antenna systems 200 and 300 are based on the antenna system 100 of FIG. 1 where corresponding parts are given corresponding reference numerals and terms. Only the differences with respect to the embodiment shown in FIG. 1A will be described in detail herein.

The antenna systems 200 and 300 of FIGS. 3A and 3B differ from the antenna system 100 in that the number of planar radiating elements 114 comprised in the radiating structure 112 of the first antenna element 210 and 310 is two, and four, respectively; and the number of band-stop filter structures 216 of the first antenna element 210, and 310 is one, and two, respectively. The at least one band-stop filter structure 216 has at least one planar conductive element 218 which also has a different shape and structure.

The first antenna element 210, 310 is adapted to a first frequency band and the second antenna element 120 is adapted to a second frequency band which is different from the first frequency band. In an embodiment, the first frequency band is lower than the second frequency band. The first frequency band includes frequencies which are smaller than that of the second frequency band.

Each of the first antenna elements 210, 310, as shown in FIGS. 3A and 3B, includes at least one radiating structure 112 and at least one band-stop filter structure 216. The following description of the at least one band-stop filter structure 216 equally applies to that comprised in the first antenna element 210 of the antenna system 200 and to that comprised in the first antenna element 310 of the antenna system 300.

The least one band-stop filter structure 216, as shown in FIGS. 3A and 3B, is configured to attenuate a current flow at a frequency in the second frequency band within the first antenna element 210; the at least one band-stop filter structure 216 suppresses current from flowing within the at least one radiating structure 114 which has a frequency in the second frequency band. The at least one band-stop filter structure 216 comprises at least one planar conductive element 218 which is electrically connected at both ends to the at least one planar radiating element 114 of the at least one radiating structure 112 such that it forms a parallel circuit therewith. In the shown embodiment, each of the at least one band-stop filter structures 216 has one planar conductive element 218. In other embodiments, the at least one band-stop filter structure 216 may have a plurality of planar conductive elements 218. In embodiments in which the at least one band-stop filter structure 216 comprises, for instance, two planar conductive elements 218, each of these two planar conductive elements 218 is electrically connected at both ends to the same portions of the at least one planar radiating element 114 such that both form a parallel circuit therewith.

As shown in FIGS. 3A and 3B, the at least one planar conductive element 218 of the at least one band-stop filter structure 216 is arranged in form of a meander pattern. The meander pattern of the at least one planar conductive element 218 allows for an excessive electrical length compared to the dimension (i.e. length and width) of the area in which it extends. In the shown embodiment, the at least one planar conductive element 218 has three consecutive loops of conductive segments pointing in opposite traverse directions. The at least one planar conductive element 218 has an electrical length which exceeds the electrical length of the at least one planar radiating element 114 to which it is connected in parallel by a half of a wavelength (λ/2) of the frequency in the second frequency band.

The at least one planar conductive element 218, as shown in FIGS. 3A and 3B, extends in a direction substantially parallel to a direction of the at least one planar radiating element 114. The at least one planar conductive element 218 and the at least one radiating element 114 are both exposed to a same radiating pattern of the second antenna element 120 inducing a current of a same magnitude and directivity therein. The at least one planar conductive element 218 and the at least one planar radiating element 114 are both arranged facing each other in two, parallel planes. This arrangement of the at least one planar conductive element 218 and least one planar radiating element 114 advantageously increases the coupling there-between. The coupling between the at least one planar conductive element 218 and least one planar radiating element 114 enhances the filtering effect of the at least one band-stop filter structure 216. The at least one planar conductive element 218, as shown in FIGS. 3A and 3B, is shaped such that it covers the width of the at least one planar radiating element 114 of the at least one radiating structure 112. The overlap between the at least one planar conductive element 218 and the at least one planar radiating element 114 is increased, further enhancing the coupling there-between.

Due to the configuration shown in FIGS. 3A and 3B of the at least one planar conductive element 218 and of the at least one planar radiating element 114 to which it is connected in parallel, the at least one band-stop filter structure 216 acts as a band-stop filter for an induced current at the frequency in the second frequency band, thereby attenuating a current flow at a frequency in the second frequency band. A current which is induced in the at least one planar conductive element 218 is exposed to an excessive electrical length of half of the wavelength (λ/2) of the frequency of the second frequency band compared to a current induced in the at least one planar radiating element 114. With a phase offset of half of the wavelength (λ/2) of the frequency of the second frequency band both currents destructively interfere (i.e. cancel each other out).

The structure, dimension and arrangement of the at least one planar conductive element 218 provide for the band-stop filter structure 216 which attenuates a current flow at a frequency in the second frequency band. Accordingly, even if the second antenna element 120 induces a current in the first antenna element 210 or 310, the at least one planar conductive element 218 of the band-stop filter structure 216 suppresses the induced current at the frequency of the second frequency band. The first antenna elements 210 and 310 are also configured to reduce interference effects at the frequency of the second frequency band, namely the frequency to which the second antenna element 120 is adapted. Accordingly, the radiating pattern of the second antenna element 120 is exposed to a reduced amount of interference from either one of the first antenna elements 210 and 310, even if the first antenna element 210 or 310 is arranged within the near-field thereof.

Figure 4A:
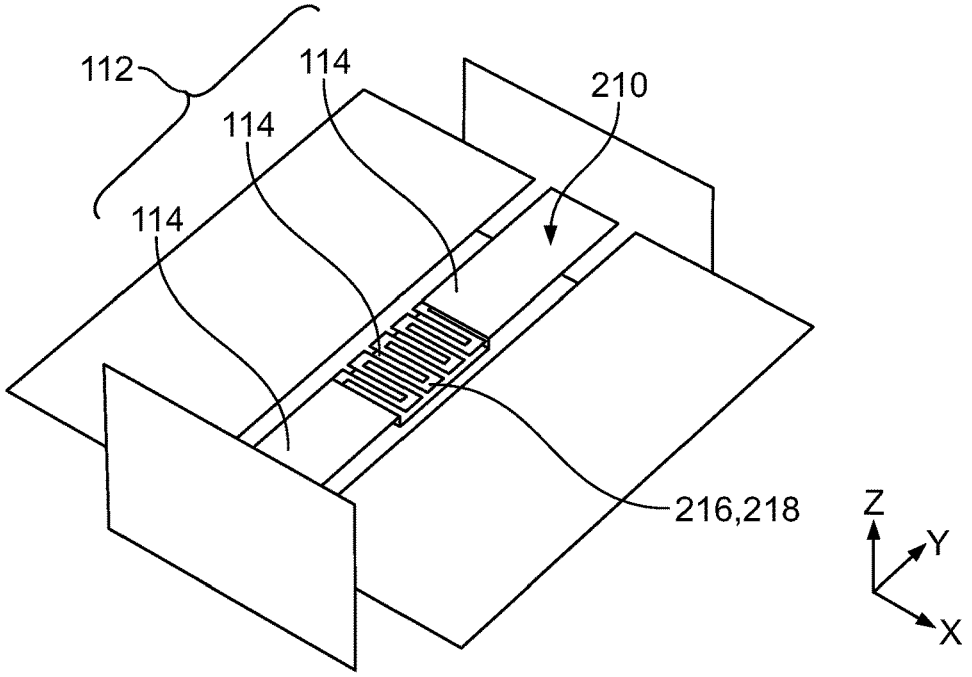
FIG. 4A is a sectional perspective view of the first antenna element of FIG. 3A.
Figure 4B:
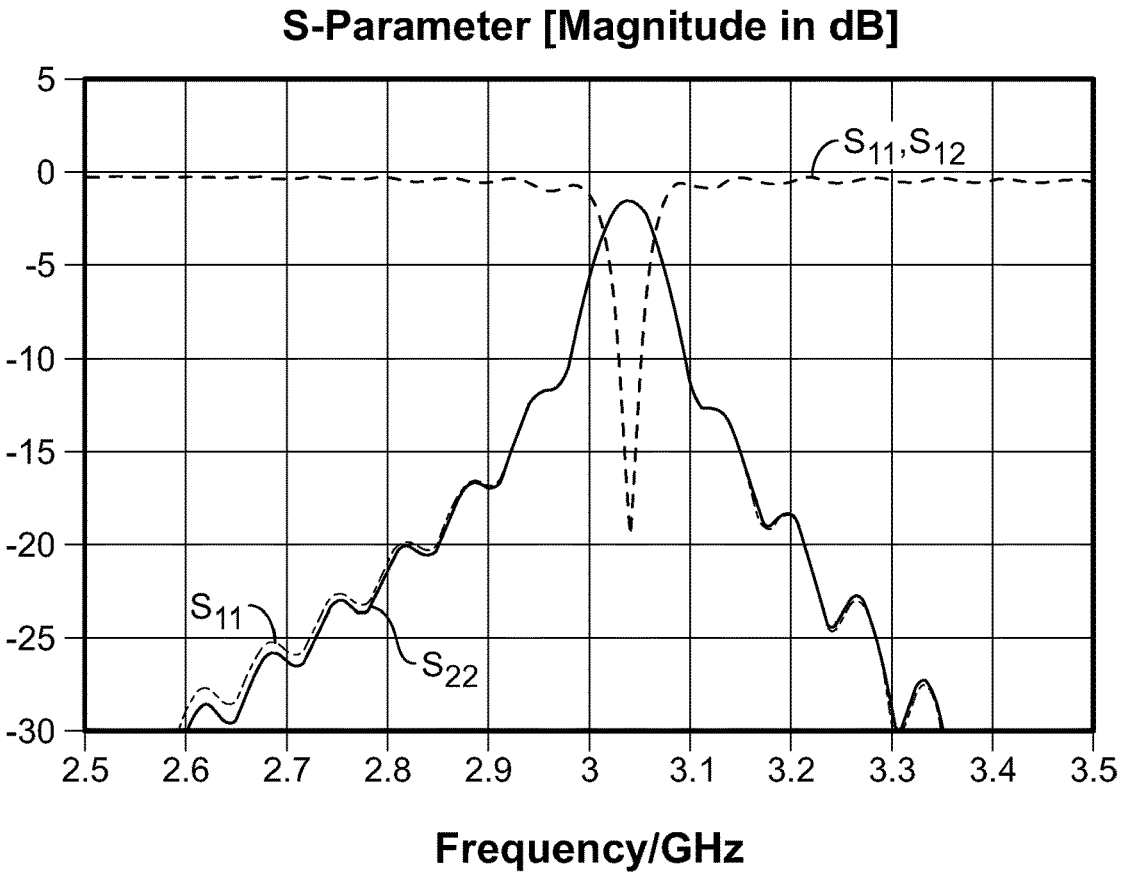
FIG. 4B is a graph of a two-port scattering parameter simulation of the first antenna element of FIG. 4A.

A two-port scattering pattern or s-parameter simulation is shown in FIG. 4B. For the simulation, the left and the right section of the first antenna element 210 shown in FIG. 4A, which applies equally to the first antenna element 310, are the ports to the two-port s-parameter simulation. As can be appreciated from the simulation results, the forward gain and the reverse gain coefficients S12 and S21 show a high attenuation at the frequency of approximately 2.3 GHz corresponding to the frequency of the second frequency range for which each of the at least one band-stop filter structure 216 is configured. The reflection coefficients S11 and S22 show an inverse behavior.

Figure 5A:
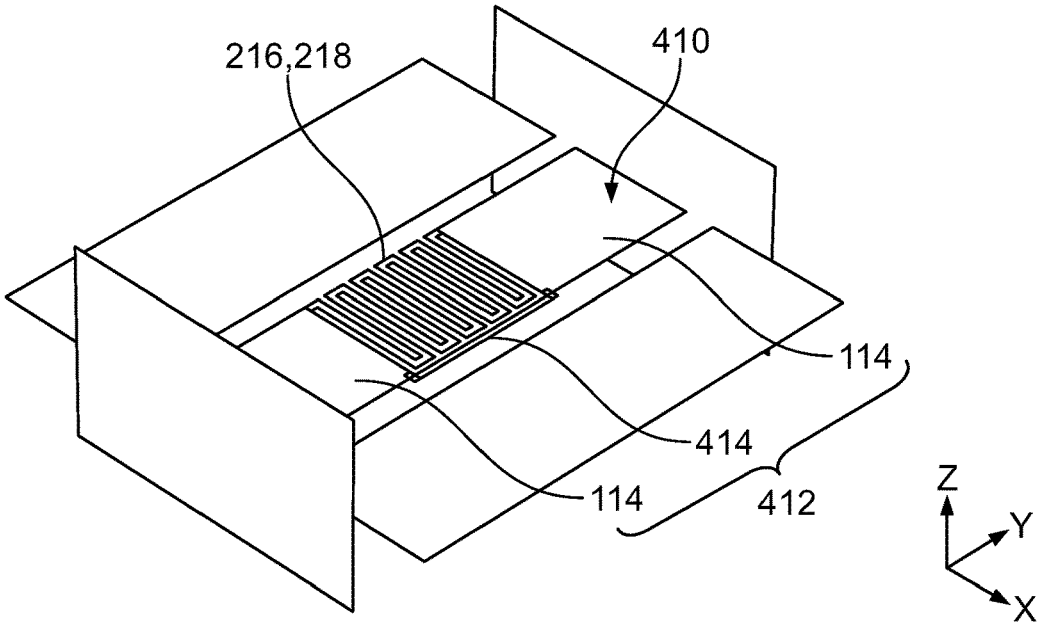
FIG. 5A is a sectional perspective view of a first antenna element of an antenna system according to another embodiment of the invention.

An antenna system according to another embodiment of the invention having a first antenna element 410 is shown in FIG. 5A. In this embodiment, the at least one planar conductive element 218 of the at least one band-stop filter structure 216 and the at least one planar radiating element 414 of the radiating structure 412 are both arranged in a same plane such that the at least one planar conductive element 218 is adjacent to the at least one planar radiating element 414 to which it is electrically connected in parallel. Even in this less complex structure of the first antenna element 410, due to configuration of the at least one planar conductive element 218 and of the at least one planar radiating element 414 to which it is connected in parallel, the at least one band-stop filter structure 216 acts as a band-stop filter for an induced current at the frequency in the second frequency band, thereby attenuating a current flow at a frequency in the second frequency band.

Figure 5B:
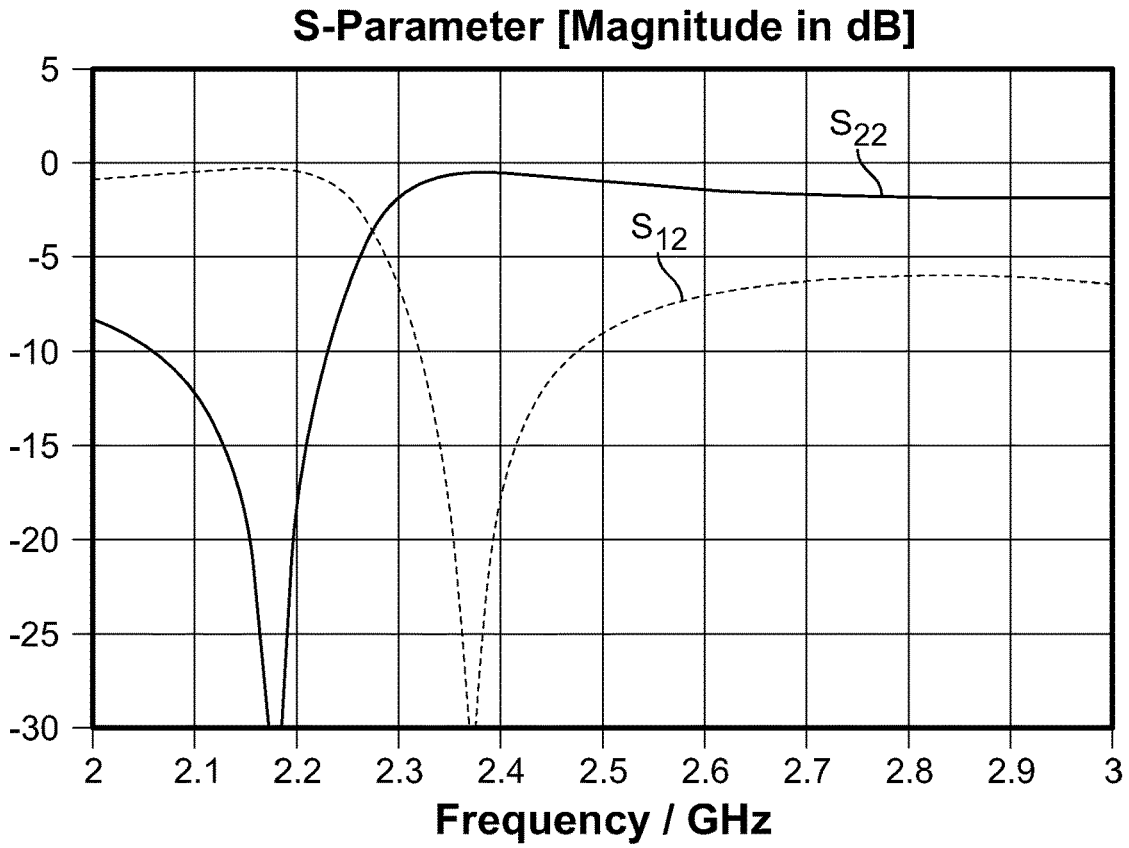
FIG. 5B is a graph of a two-port scattering parameter simulation of the first antenna element of FIG. 5A.

A two-port scattering pattern or s-parameter simulation is shown in FIG. 5B. For the simulation, the left and the right section of the first antenna element 410 shown in FIG. 5A are the ports to the two-port s-parameter simulation. As can be appreciated from the simulation results, the forward gain coefficient S12 shows a high attenuation at the frequency of approximately 2.3 GHz corresponding to the frequency of the second frequency range for which each of the at least one band-stop filter structure 216 is configured. The reflection coefficients S22 show an inverse behavior.

Figure 6A:
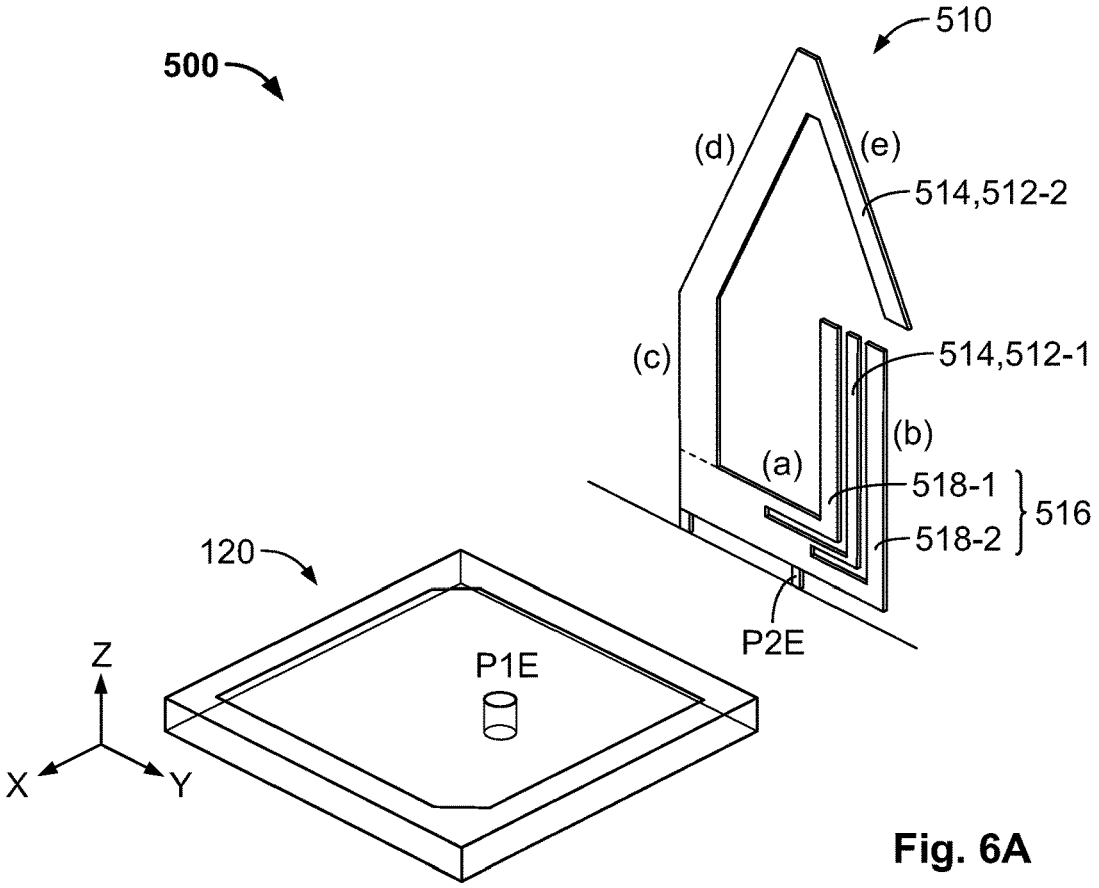
FIG. 6A is a perspective view of an antenna system according to another embodiment of the invention.
Figure 6B:
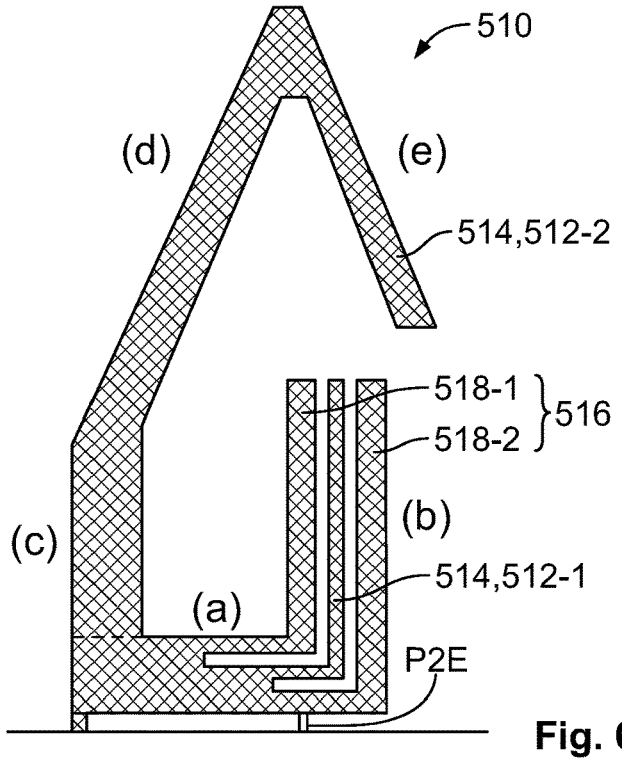
FIG. 6B is a sectional front view of a first antenna element of the antenna system of FIG. 6A.

An antenna system 500 according to another embodiments of the invention is shown in FIGS. 6A and 6B. The antenna system 500 comprises a first antenna element 510 and the second antenna element 120 which are both arranged within the near-field to each other. Accordingly, the radiation pattern of the second antenna element 120 is exposed to interference effects from the first antenna element 510 and vice-versa.

The first antenna element 510 is adapted to transmit/receive electromagnetic waves of a first frequency band; the first antenna element 510 is adapted to the first frequency band. In the shown embodiment, the first antenna element 510 is a multi-band planar inverted-F antenna (PIFA). The first antenna element 510 includes a feeding point which is indicated as "P2E". The second antenna element 120 includes a feeding point which is indicated as "P1E".

The first antenna element 510, as shown in FIGS. 6A and 6B, has at least one radiating structure 512-1, 512-2 configured to radiate at a frequency in the first frequency band. In the shown embodiment, the first antenna element 510 has three interconnected radiating structure 512-1, 512-2. The first antenna element 510 includes a first antenna structure 512-1 which includes a branch (a) extending along the ground plane of the first antenna element 510 and another branch (b) pointing away from the ground plane, a second antenna structure 512-2 which includes branch (c) extending away from the ground plane and branches (d) and (e) forming a semi-circle pointing towards the ground plane, and a third antenna structure which includes the two above antenna structures 512-1, 512-2 with the branches (a), (b), (c), (d) and (e). Each of the three shown antenna structures 512-1, 512-2 of the first antenna element 510 is configured to radiate at a different frequency in the first frequency band.

The at least one radiating structure 512-1, 512-2, as shown in FIGS. 6A and 6B, comprises at least one planar radiating element 514. In the shown embodiment, the multi-band radiating structure 512-1, 512-2 has one planar radiating element 514. In other embodiments, the radiating structure 512-1, 512-2 may have a plurality of planar radiating elements 514.

The first antenna element 510, as shown in FIGS. 6A and 6B, further comprises at least one sleeve structure 516 configured to attenuate a current flow at a frequency in the second frequency band within the first antenna element 510. The at least one sleeve structure 516 suppresses current from flowing within the at least one radiating structure 514 which has the frequency in the second frequency band to which the at least one sleeve structure 516 is configured. The sleeve structure 516 can be regarded as an open-short transmission resonator, which is one form of a band-stop filter.

The at least one sleeve structure 516, as shown in FIGS. 6A and 6B, has at least two planar conductive elements 518-1, 518-2 which are electrically connected at one end to the at least one planar radiating element 514 of the at least one radiating structure 512-1, 512-2. In the shown embodiment, the at least one sleeve structure 516 has two planar conductive elements 518-1, 518-2. However, in other embodiments, the at least one band-stop filter structure 516 may also have four sleeve structures which are arranged in the front and back and to the left and right of the at least one radiating structure 512-1, 512-2.

Each of the at least two planar conductive elements 518-1, 518-2 of the at least one sleeve structure 516 has an electrical length which correspond to substantially a quarter of a wavelength ($\lambda/4$) of the frequency in the second frequency band. Each of the least two planar conductive elements 518-1, 518-2 has an individual electrical length which deviates from a quarter of a wavelength ($\lambda/4$) of the frequency in the second frequency band, for instance, in the region of 0-5%. It has proven advantageous to individually configure the electrical length of the at least two planar conductive elements 518-1, 518-2 since their adjacent arrangement on both sides of the at least one planar radiating element 514 results in a highly-coupled resonant behavior. This highly-coupled resonant behavior may mistune the at least one sleeve structure 516.

The at least two planar conductive elements 518-1, 518-2 of the at least one sleeve structure 516, as shown in FIGS. 6A and 6B, extend in a direction substantially in parallel to a direction of the at least one planar radiating element 514 of the at least one radiating structure 512-1, 512-2. The at least two planar conductive elements 518-1, 518-2 extend in the same direction as the at least one planar radiating element 514. In the shown embodiment, the at least one planar radiating element 514 has an inverted-L shape and hence extends in two directions, namely in a horizontal and a lateral direction with respect to a ground plane. The at least two planar conductive elements 518-1, 518-2 also extend in two directions; both directions are substantially in parallel to the respective of the horizontal and lateral direction in which the at least one planar radiating element 514 extends. The at least two planar conductive elements 518-1, 518-2 of the at least one sleeve structure 516 and the at least one planar radiating element 514 of the at least one radiating structure 512-1, 512-2 are both arranged in a same plane. In the shown embodiment, the at least one planar radiating element 514 and the at least two planar conductive elements 518-1, 518-2 are provided on a same surface of a dielectric substrate (for instance by printing/etching).

The at least one planar radiating element 514 and the at least two planar conductive elements 518-1, 518-2 not only extend in directions which are substantially in parallel to each other but further, each of the at least two planar conductive elements 518-1, 518-2 of the at least one sleeve structure 516 is arranged equidistantly to the at least one planar radiating element 514 of the at least one radiating structure 512-1, 512-2. Both the at least one planar radiating element 514 and the at least two planar conductive elements 518-1, 518-2 have opposing edges; on the inside of the at least two planar conductive elements 518-1, 518-2 of the at least one sleeve structure 516 and on the outside of the at least one radiating element 514 of the at least one radiating structure 512-1, 512-2. Hence, electric current which flows on both the at least one planar radiating element 514 and the at least two planar conductive elements 518-1, 518-2 counteract with each other.

Between each of the at least two planar conductive elements 518-1, 518-2 of the at least one sleeve structure 516 and the at least one planar radiating element 514 of the at least one radiating structure 512-1, 512-2, a respective slit is formed as shown in FIGS. 6A and 6B. The at least two slits are defined by the area which is surrounded (or enclosed) by each of the at least two planar conductive elements 518-1, 518-2 and the at least one planar radiating element 514. Each of these at least two slits extends laterally from the tip of the at least one planar radiating element of the at least one radiating structure 514 to the electrical connection between the respective one of the at least two planar conductive elements 518-1, 518-2 and the at least one planar radiating element 514. At the tip, each of the at least two planar conductive elements 518-1, 518-2 and the at least one radiating element 514 are flush with each other.

Due to the configuration of the at least two planar conductive elements 518-1, 518-2 and of the at least one planar radiating element 514 to which both are electrically connected, the at least one sleeve structure 516 suppresses current from flowing at the frequency in the second frequency band, thereby attenuating—in the far-field—the radiation power in the second frequency band. The at least two planar conductive elements 518-1, 518-2 of the at least one sleeve structure 516 act as a transmission line which is short circuited at the end. By applying Gauss' Law any current which flows on the inside of the at least two planar conductive elements 518-1, 518-2 has to be opposite of another current which flows on the outside of the at least one planar radiating element 514. The terms inside and outside refer to the opposing edges of the at least two planar conductive elements 518-1, 518-2 and the at least one planar radiating element 514. Hence, the current which flows on the outside of the at least one planar radiating element 514 also sees a short-circuited transmission line.

Since the at least two planar conductive elements 518-1, 518-2 of the at least one sleeve structure 516 have an electrical length which correspond to substantially a quarter of a wavelength (λ/4) of the frequency in the second frequency band, the impedance at the frequency which the current sees that flows on the outside of the at least one planar radiating element 514 is infinity. Hence, due to this configuration of the at least two planar conductive elements 518-1, 518-2 and of the at least one planar radiating element 514 to which both are electrically connected, the at least one sleeve structure 516 suppresses current from flowing at the frequency in the second frequency band.

Figure 7A:
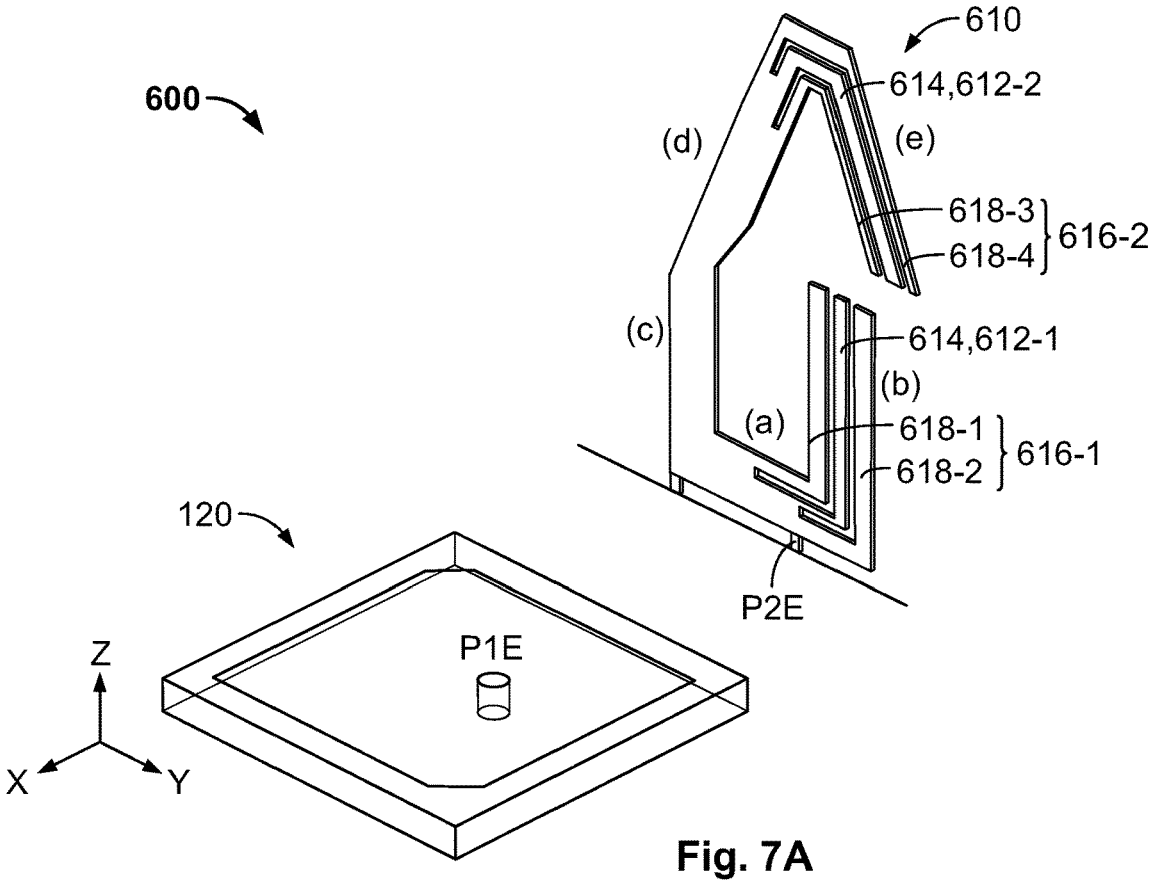
FIG. 7A is a perspective view of an antenna system according to another embodiment of the invention.
Figure 7B:
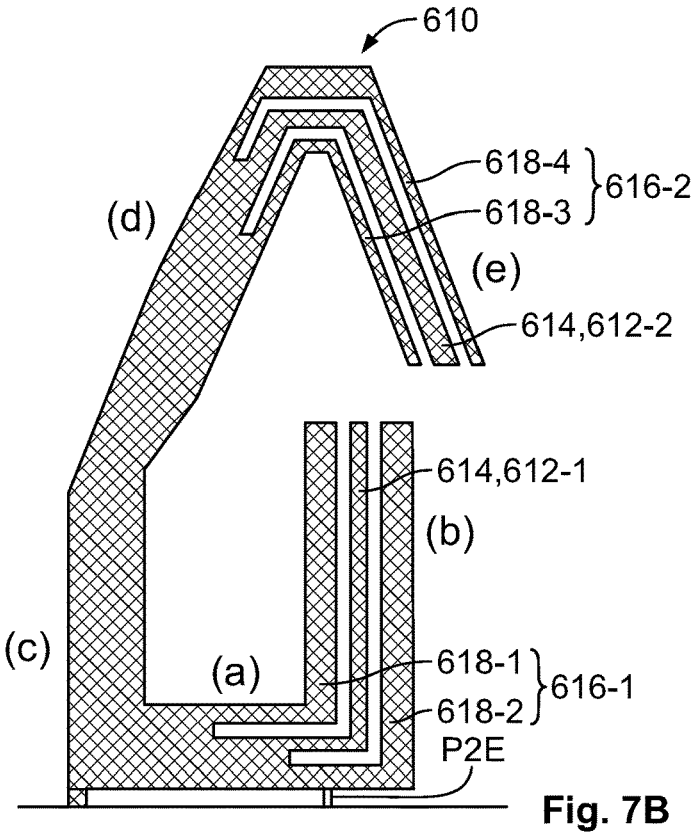
FIG. 7B is a sectional front view of a first antenna element of the antenna system of FIG. 7A.

An antenna system 600 according to another embodiment of the invention is shown in FIGS. 7A and 7B. The antenna system 600 is similar to the antenna system 500 of FIGS. 6A and 6B, where corresponding parts are given corresponding reference numerals and terms. Only the differences with respect to the embodiment of FIGS. 6A and 6B will be described in detail.

The antenna system 600 differs from the antenna system 500 in that the first antenna element 610 comprises three interconnected radiating structures 612-1, 612-2 each of which includes at least one sleeve structure 616-1, 616-2. Each of the at least one sleeve structure 616-1, 616-2 is configured to attenuate a same frequency in the second frequency band and includes two planar conductive elements 618-1, 618-2, 618-3, 618-4. Additionally, each of the at least one sleeve structure 616-1, 616-2 is electrically connected to one planar radiating element 614 in each of the three radiating structures 612-1, 612-2. Due to this configuration of the at least two planar conductive elements 618-1, 618-2, 618-3, 618-4 and of the at least one planar radiating element 614 to which both are electrically connected, the at least one sleeve structure 616-1, 616-2 suppresses current from flowing at the frequency in the second frequency band, thereby attenuating—in the far-field—the radiation power in the second frequency band.

Figure 7C:
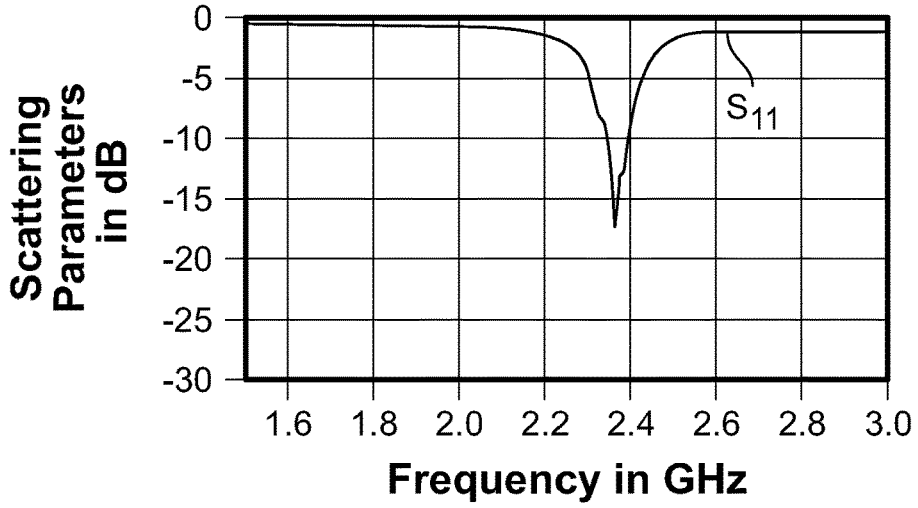
FIG. 7C is a first simulation result of the antenna system of FIG. 7A.
Figure 7D:
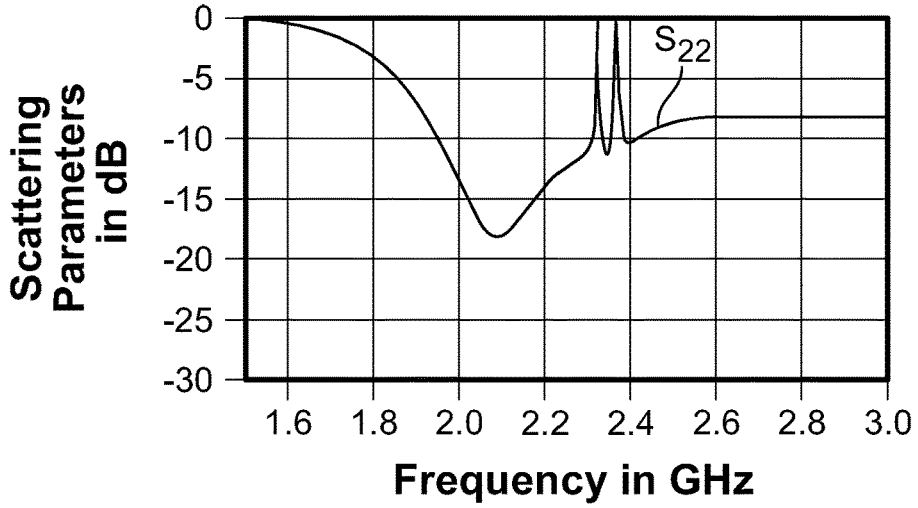
FIG. 7D is a second simulation result of the antenna system of FIG. 7A.
Figure 7E:
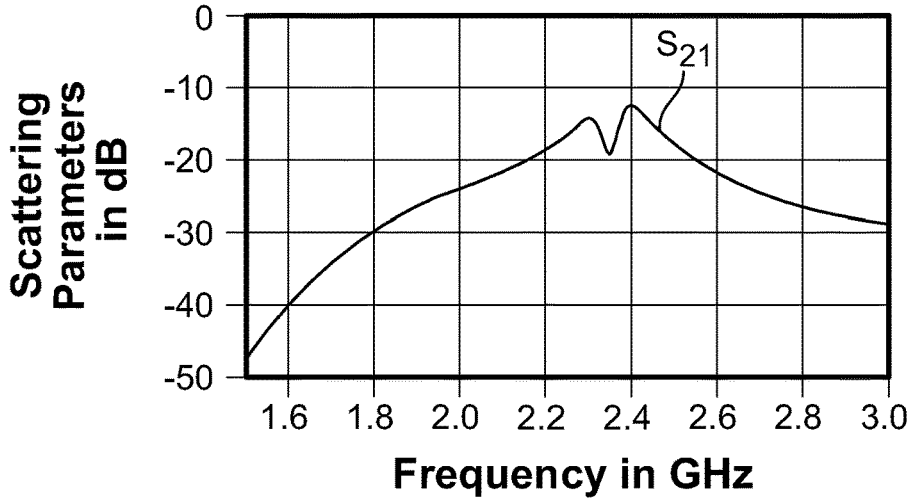
FIG. 7E is a third simulation result of the antenna system of FIG. 7A.

Simulation results of an interference effect on the second antenna element 120, a filtering effect by the first antenna element 610, and a decoupling effect between the first antenna element 620 and the second antenna element 120 of the antenna system 600 are shown in FIGS. 7C-7E. The results for the antenna system 600 are provided in form of a two-port scattering parameter (or s-parameter) simulation where the two ports are connected to the feeding line of the second antenna element 120 (denoted P1E in the FIG. 7A) and to the feeding line of the first antenna element 610 (denoted P2E), respectively. As can be appreciated from the simulation results, the reflection coefficient S11 shows the reduced interference effect where the attenuation corresponds to the frequency of the second frequency range for which each of the at least one sleeve structure 616-1, 616-2 is configured, the reflection coefficient S22 showing the filtering effect by the first antenna element 610, and reverse gain coefficient S21 show a decoupling effect at the frequency of approximately 2.3 GHz. The reflection coefficients S11 and S22 show an inverse behavior.

Each of the above discussed antenna systems of the various embodiments can be included in an antenna module for use on a vehicle rooftop. For this purpose, an antenna module, in addition to the antenna system, comprises a housing for protecting the antenna system from outside influences, a base for arranging the antenna system thereon, an antenna matching circuit, and an electrical connection for transmitting/receiving electrical signals from the outside to/from the first antenna element and the second antenna elements of the antenna system. Further, the vehicle rooftop provides for a ground plane to the first planar antenna element and the second antenna element of the antenna system.

What is claimed is:

1. An antenna system, comprising:

a first antenna element adapted to a first frequency band and including (a) a radiating structure having a plurality of planar radiating elements and configured to radiate at a frequency in the first frequency band, the plurality of planar radiating elements are arranged in a first plane and a second plane parallel to each other in an interleaved manner; and (b) a plurality of band-stop filters each having a planar conductive element electrically connected to a different one of the planar radiating elements and configured to attenuate a current flow at a frequency in a second frequency band different from the first frequency band, the planar conductive element:

(1) arranged in a meander pattern, (2) having an end electrically connected to the different one of the planar radiating elements, (3) extending in a direction substantially parallel to the different one of the planar radiating elements, and (4) having an electrical length substantially equal to ¼ of a wavelength of the frequency in the second frequency band; and a second antenna element adapted to the second frequency band.

2. The antenna system of claim 1, wherein the second antenna element is arranged within a near-field of the first antenna element.

3. The antenna system of claim 1, wherein the planar conductive element covers a width of the different one of the planar radiating elements and/or the planar conductive element has a same width as the different one of the planar radiating elements.

4. The antenna system of claim 1, wherein the planar conductive element and the different one of the planar radiating elements are disposed on two opposite surfaces of a dielectric substrate or the planar conductive element and the different one of the planar radiating elements are disposed on a same surface of the dielectric substrate.

5. The antenna system of claim 1, wherein each planar radiating element has an electrical length of less than or equal to ⅜ of the wavelength of the frequency in the second frequency band.

6. The antenna system of claim 1, wherein the first planar antenna element is a multi-band planar inverted-F antenna and/or the second antenna element is a corner-truncated rectangular patch antenna.

7. The antenna system of claim 1, wherein the planar conductive element of each of the plurality of band-stop filters is arranged in the first plane and faces one of the plurality of planar radiating elements arranged in the second plane.

8. An antenna system, comprising:

a first antenna element adapted to a first frequency band and including (a) a radiating structure having a plurality of planar radiating elements and configured to radiate at a frequency in the first frequency band, the plurality of planar radiating elements are arranged in a first plane and a second plane parallel to each other in an interleaved manner; and (b) a plurality of band-stop filters each having a planar conductive element electrically connected to a different one of the planar radiating elements and configured to attenuate a current flow at a frequency in a second frequency band different from the first frequency band, the planar conductive element:

(1) arranged in a meander pattern, (2) having each of a pair of opposite ends electrically connected to the different one of the planar radiating elements to form a parallel circuit with the different one of the planar radiating elements, (3) extending in a direction substantially parallel to the different one of the planar radiating elements, and (4) having an electrical length greater than an electrical length of the different one of the planar radiating elements by ½ a wavelength of the frequency in the second frequency band; and a second antenna element adapted to the second frequency band.

9. The antenna system of claim 8, wherein the second antenna element is arranged within a near-field of the first antenna element.

10. The antenna system of claim 8, wherein the planar conductive element covers a width of the different one of the planar radiating elements and/or the planar conductive element has a same width as the different one of the planar radiating elements.

11. The antenna system of claim 8, wherein the planar conductive element and the different one of the planar radiating elements are disposed on two opposite surfaces of a dielectric substrate or the planar conductive element and the different one of the planar radiating elements are disposed on a same surface of the dielectric substrate.

12. The antenna system of claim 8, wherein each planar radiating element has an electrical length of less than or equal to ⅜ of the wavelength of the frequency in the second frequency band.

13. The antenna system of claim 8, wherein the planar conductive element of each of the plurality of band-stop filters is arranged in the first plane and faces one of the plurality of planar radiating elements arranged in the second plane.

14. An antenna system, comprising:

a first antenna element adapted to a first frequency band and including (a) a radiating structure having a planar radiating element and configured to radiate at a frequency in the first frequency band; and (b) a sleeve structure having a plurality of planar conductive elements configured to attenuate a current flow at a frequency in a second frequency band different from the first frequency band, the plurality of planar conductive elements each:

(1) having an end electrically connected to the planar radiating element, (2) extending in a direction substantially parallel to the planar radiating element, and (3) having an electrical length substantially equal to ¼ of a wavelength of the frequency in the second frequency band; and a second antenna element adapted to the second frequency band.

15. The antenna system of claim 14, wherein the second antenna element is arranged within a near-field of the first antenna element.

16. The antenna system of claim 14, wherein the plurality of planar conductive elements and the planar radiating element are disposed in a same plane such that the plurality of planar conductive elements are adjacent to the planar radiating element.

17. The antenna system of claim 14, wherein each of the planar conductive elements is disposed equidistant to the planar radiating element.

18. The antenna system of claim 14, wherein a plurality of slits are disposed between the plurality of planar conductive elements and the planar radiating element, each of the slits extending laterally from a tip of the planar radiating element to an electrical connection between the planar conductive elements and the planar radiating element.

19. The antenna system of claim 14, wherein the planar radiating element includes a plurality of interconnected radiating structures each configured to radiate at a different frequency in the first frequency band and a plurality of sleeve structures each configured to attenuate a current flow at a same frequency in the second frequency band, each sleeve structure including a plurality of planar conductive elements electrically connected to a different radiating structure.

20. An antenna module for use on a vehicle rooftop, comprising:

an antenna system including a first antenna element adapted to a first frequency band and a second antenna element adapted to a second frequency band different from the first frequency band, the vehicle rooftop providing a ground plane for the first antenna element and the second antenna element, the first antenna element including (a) a radiating structure having a plurality of planar radiating elements and configured to radiate at a frequency in the first frequency band, the plurality of planar radiating elements are arranged in a first plane and a second plane parallel to each other in an interleaved manner; and (b) a plurality of band-stop filters each having a planar conductive element electrically connected to a different one of the planar radiating elements and configured to attenuate a current flow at a frequency in a second frequency band different from the first frequency band, the planar conductive element:

(1) arranged in a meander pattern, (2) having an end electrically connected to the different one of the planar radiating elements, (3) extending in a direction substantially parallel to the different one of the planar radiating elements, and (4) having an electrical length substantially equal to ¼ of a wavelength of the frequency in the second frequency band.

* * * * *